US007694733B2

(12) United States Patent
Clark et al.

(10) Patent No.: US 7,694,733 B2
(45) Date of Patent: Apr. 13, 2010

(54) CENTRALIZER

(75) Inventors: Alistair Bertram Clark, Westhill (GB); Ian Alastair Kirk, Milltimber (GB); William Barron, Bieldside (GB)

(73) Assignee: Downhole Products PLC, Portlethen, Aberdeen (GB)

( * ) Notice: Subject to any disclaimer, the term of this patent is extended or adjusted under 35 U.S.C. 154(b) by 198 days.

(21) Appl. No.: 11/795,460

(22) PCT Filed: Jan. 18, 2006

(86) PCT No.: PCT/GB2006/000166

§ 371 (c)(1),
(2), (4) Date: Jul. 17, 2007

(87) PCT Pub. No.: WO2006/077399

PCT Pub. Date: Jul. 27, 2006

(65) Prior Publication Data

US 2008/0210419 A1 Sep. 4, 2008

(30) Foreign Application Priority Data

Jan. 18, 2005 (GB) ..... 0501056.6

(51) Int. Cl.
*E21B 17/10* (2006.01)

(52) U.S. Cl. ..... 166/244.1; 166/241.6

(58) Field of Classification Search ..... 166/241.6, 166/241.1, 378, 244.1
See application file for complete search history.

(56) References Cited

U.S. PATENT DOCUMENTS 3,065,005 A * 11/1962 Hall, Sr. et al. ..... 403/6
3,080,926 A * 3/1963 Remp, Jr. ..... 166/241.6
3,578,084 A * 5/1971 Bombardieri et al. ..... 166/288
3,963,075 A * 6/1976 Evans ..... 166/241.6
4,071,101 A 1/1978 Ford
4,083,612 A 4/1978 Olson
4,463,487 A * 8/1984 Raggi ..... 29/888.076
H001192 H * 6/1993 Keller ..... 166/241.6
5,339,896 A * 8/1994 Hart et al. ..... 166/241.1
5,810,100 A 9/1998 Samford
5,833,019 A * 11/1998 Gynz-Rekowski ..... 175/325.6
5,901,798 A 5/1999 Herrera et al.
6,435,275 B1 * 8/2002 Kirk et al. ..... 166/241.1
6,830,102 B2 * 12/2004 Kirk et al. ..... 166/241.6
7,357,178 B2 * 4/2008 Thornton ..... 166/241.6
2001/0032722 A1 * 10/2001 Eaton ..... 166/241.4
2003/0164236 A1 9/2003 Thornton
2004/0188147 A1 * 9/2004 Mitchell et al. ..... 175/325.3
2006/0070731 A1 * 4/2006 Fouillou et al. ..... 166/241.4
2008/0164019 A1 * 7/2008 Angman ..... 166/241.6

FOREIGN PATENT DOCUMENTS

DE 1187567 11/1965

* cited by examiner

*Primary Examiner*—Shane Bomar
(74) *Attorney, Agent, or Firm*—Drinker Biddle & Reath, LLP

(57) ABSTRACT

A centralizer having a body with an inner surface provided with a friction-reducing slider, typically located in an annular recess on the inner surface of the body of the slider, spaced from the ends of the body. The slider can be formed separately from a body of the centralizer and subsequently attached thereto on the inner surface so that it is adapted to bear between the outer surface of the tubing to be centralized and the inner surface of the centralizer. This reduces rotational torque transmitted between the centralizer and the tubing, and assists in maneuvering of the tubular string into the desired position in the well.

18 Claims, 2 Drawing Sheets

CENTRALIZER

RELATED APPLICATION

This Application is the U.S. National Phase Application of PCT International Application No. PCT/GB06/000166 filed Jan. 18, 2006.

1. Field of the Invention

The present invention relates to a centraliser and typically to a casing centraliser.

2. Description of the Related Art

Centralisers are conventionally used to maintain a tubular such as casing in the centre of a borehole and to space it from the borehole walls. This facilitates an even flow of cement through the annulus between the casing and the borehole once the tubular is in the desired position.

When a tubular string is run into a well, the frictional resistance encountered is generally a significant factor and known designs of centraliser are often used as bearing devices in order to reduce the friction between the outer surface of the centraliser and the inner surface of the borehole.

BRIEF SUMMARY OF THE INVENTION

According to the present invention there is provided a centraliser having a body with an inner surface provided with a friction-reducing slider.

The friction-reducing slider can be formed separately from a body of the centraliser and subsequently attached thereto on the inner surface so that it is adapted to bear between the outer surface of the tubing to be centralised and the inner surface of the centraliser. This reduces rotational torque transmitted between the centraliser and the tubing, and assists in maneuvering of the tubular string into the desired position in the well.

The friction-reducing slider can be inserted into a recess on the inner surface of the centraliser body and is optionally in the form of an annular ring located within an annular recess and having an inner diameter that is less than the inner diameter of the centraliser body, so that a portion of the friction reducing slider protrudes radially from the recess into the bore of the centraliser, so as to bear against the tubular within the bore, thereby spacing the inner surface of the bore of the centraliser from the tubular to be centralised.

The recess can thus be an annular recess shaped to receive the annular ring and, in favoured embodiments, both the annular ring and the annular recess can be set at right angles to the axis of the bore of the centraliser.

The centraliser typically has blades on the outer surface adapted to bear against the inner surface of the borehole in which the centraliser is to be used, and typically the body and the blades are formed by casting the centraliser as an unit. In some embodiments, the blades can be formed separately and then subsequently attached to the centraliser body and in such embodiments, the body of the centraliser is typically is formed as unit, typically by casting.

Typically, the annular groove to receive the annular ring of the friction reducing slider is spaced from the end of the centraliser, and is optionally an internal groove with radially-extending walls around the circumference at each end of the groove. The friction-reducing slider is typically formed (e.g. machined) as a unitary band. The outer diameter of the band is typically oversized with respect to the inner diameter of the groove so that the band has to be deformed before being inserted into the groove. This means that the band can be a very tight fit within the groove and is held securely therein by radial compression of the outer diameter of the band by the inner diameter of the groove and by the radially-extending end walls of the groove.

Typically, the friction-reducing slider may comprise one or more of polytetrafluoroethylene (PTFE), polyetheretherketone, carbon reinforced polyetheretherketone, polyphthalamide, plyvinylindene fluoride, polyphenylylene sulphide, polyetherimide, polyethylene, polysulphone, polyethersulphone, polybutyleneterephthalate, polyetherketoneketone, polyamides, rubber and rubber compounds, phenolic resins or compounds, thermosetting plastics, thermoplastic elastomers; thermoplastic compounds or thermoplastic polyester resins.

Typically, the annular friction reducing slider is machined from a cylindrical bar of low friction plastics material such as PTFE. Typically, the outer diameter is machined on a lathe and the inner diameter is then subsequently bored until the desired thickness of annular ring is obtained (typically 0.1 inch (0.254 cm)).

The invention also comprises a method of making a centraliser, the method comprising forming a body of the centraliser with a bore having an inner surface; forming a recess on the inner surface of the body of the centraliser, and locating a friction-reducing slider in the recess of the body.

The invention also provides a method of forming a friction-reducing slider for a centraliser, the method comprising machining the slider in the form of a one-piece annular ring by turning the outer diameter and boring the inner diameter thereof.

BRIEF DESCRIPTION OF THE SEVERAL VIEWS OF THE DRAWINGS

An embodiment of the present invention will now be described, by way of example only, and with reference to the accompanying drawings, in which:—

DETAILED DESCRIPTION OF THE INVENTION

Figure 2:
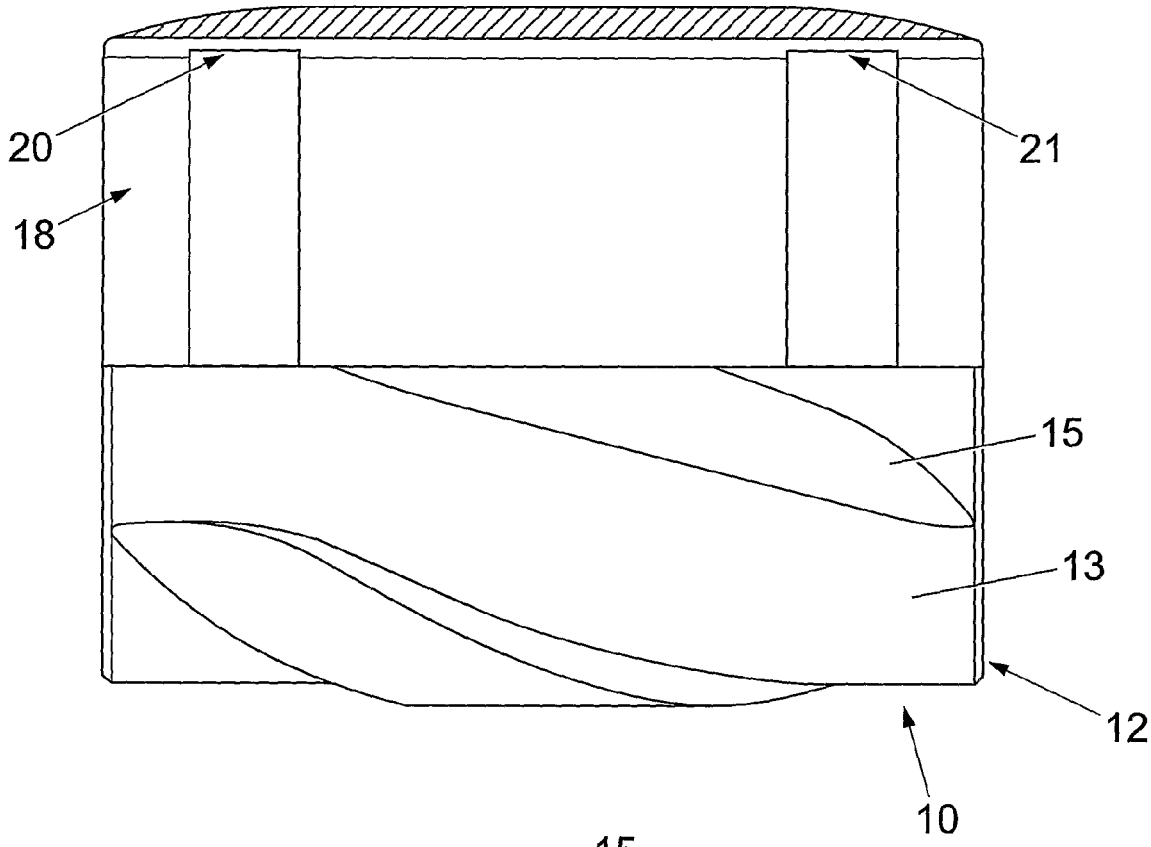
FIG. 2 is a side sectional view of a body of the centraliser according to the invention.
Figure 1:
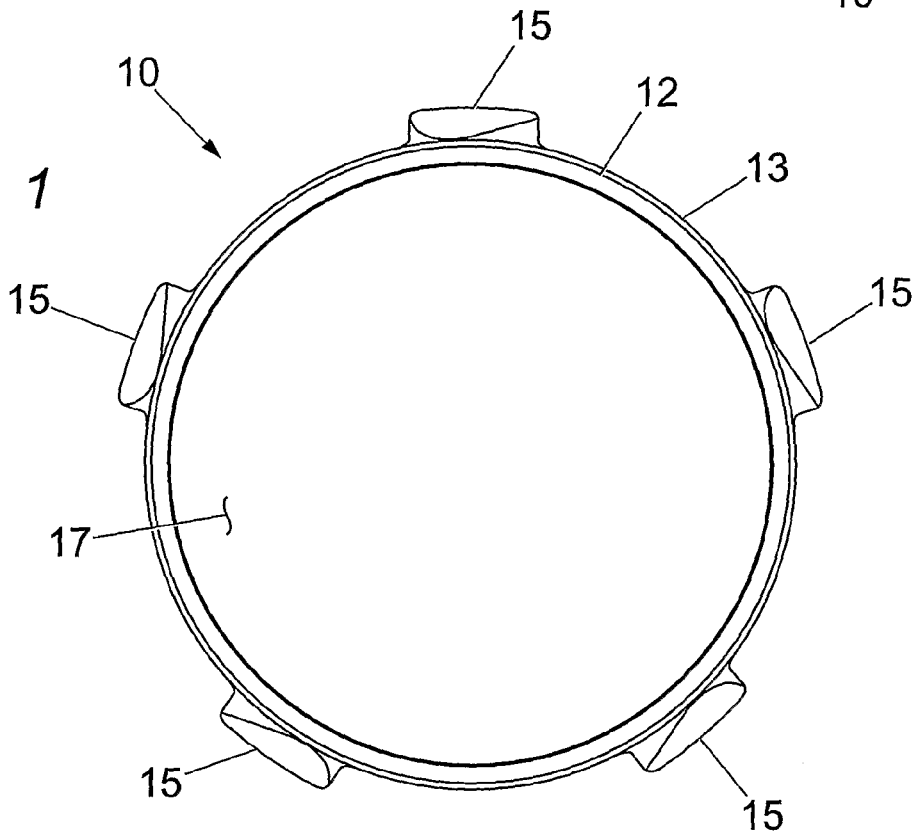
FIG. 1 is a plan view of a centraliser according to the invention.
Figure 3:
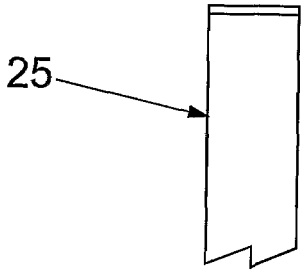
FIGS. 3 and 4 are side cut-away views of annular friction reducing sliders used in the centraliser of FIG. 1.
Figure 4:
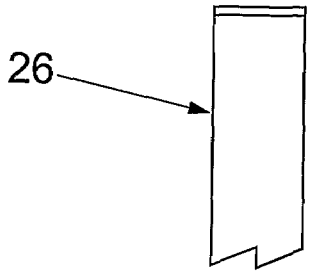
Figure 5:
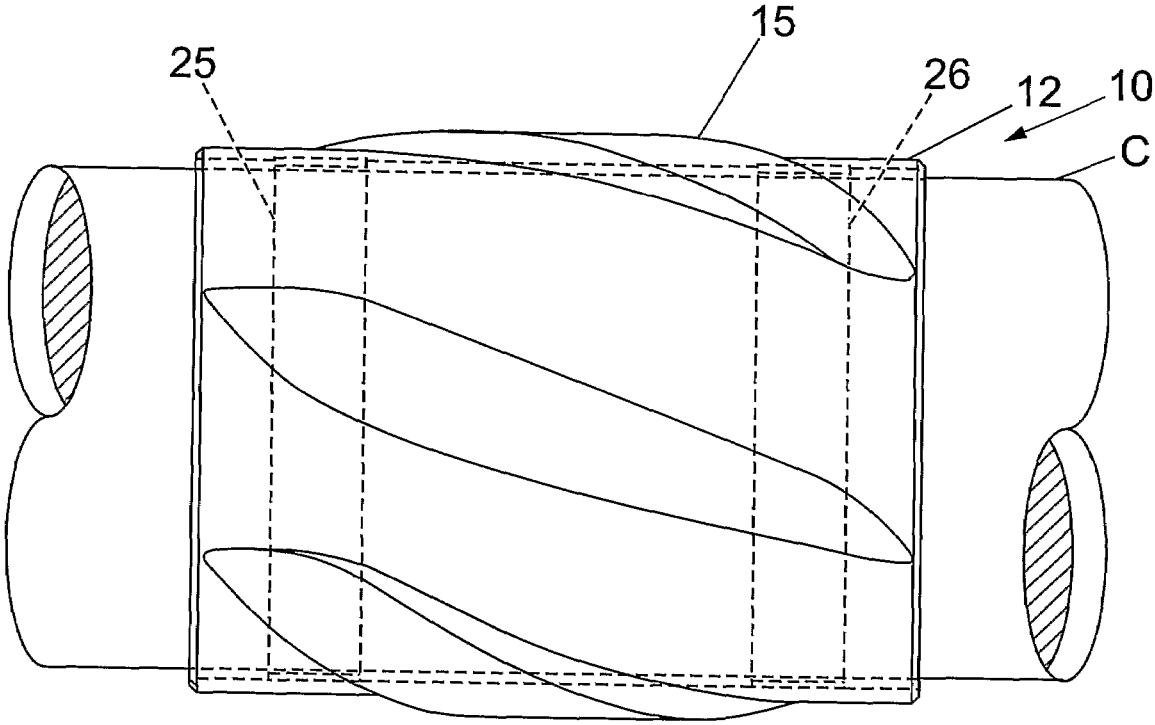
FIG. 5 is a side view of a centraliser according to FIG. 1 in place on a length of casing.

Referring now to the drawings, a centraliser 10 has a body 12 with an outer surface 13, on which are disposed a number of blades 15 for bearing against the inner surface of a borehole in which the centraliser is deployed.

The body 12 has a central bore 17 having an inner surface 18. The bore 17 is typically tapered so that the diameter of the bore at one end of the centraliser is slightly larger than at the other end, to assist in the recovery of the centraliser body 12 from a mould during casting. The inner surface 18 of the bore 17 has a pair of annular grooves 20, 21 disposed perpendicular to the axis of the bore 17 and extending circumferentially around the inner surface 18.

The grooves 20, 21 are adapted to receive annular friction-reducing sliders, typically in the form of rings of plastics materials, typically of PTFE or some similar low-friction plastics material. The PTFE rings 25, 26 are disposed in the grooves 20 and 21 respectively and are dimensioned so that the outer diameter of each ring 25, 26 is slightly larger than the inner diameter of its respective groove 20, 21, so that the rings 25 and 26 need to be deformed, for example folded, before being released to spring into place within the grooves. The axial dimensions of the rings and the grooves are also closely matched so that the radial walls at the ends of the grooves prevent axial movement of the rings when lodged therein.

The inner diameters of the rings 25, 26 are also formed so as to be slightly smaller than the inner diameters of the bore 17 of the body 12 in the areas adjacent to the grooves 20, 21. Thus, when the rings 25, 26 are snapped into place in the grooves 20, 21 respectively, they protrude radially inward from the inner surface 18 of the bore 17. The typical thickness of the rings is 0.1 inch (0.254 cm) and this is typically kept very thin so that the depths of the grooves 20, 21 do not sacrifice too much wall thickness of the body 12. Typically, the grooves 20, 21 extend more than half way through the wall thickness of the body 12.

The dimensions of the body 12, grooves 20, 21 and rings 25, 26 are such that when the rings 25, 26 are in place in their respective grooves 20, 21, a string of casing C disposed in the bore 17 is spaced from the inner surface 18 of the body 12 by the protruding portions of the rings 25, 26 that extend radially inward from the inner surface 18.

The axial lengths of the sliders 25, 26, are typically sufficient to provide an effective bearing surface between the sliders 25, 26 and the casing string C so that the casing string C can slide axially and rotate around the axis of the body 12 while bearing on the inner surface of the rings 25, 26, rather than on the inner surface 18 of the body 12 of the centraliser. Bearing against the inner surfaces of the PTFE rings reduces the frictional co-efficient between the casing string C and the centraliser 10 and so reduces the rotational torque that needs to be applied to the casing string C in order to manoeuvre it into position. Also the axial drag that is applied between the centraliser 10 and the casing string C is likewise reduced.

Modifications and improvements may be incorporated without departing from the scope of the invention. For example, the friction-reducing slider can simply be a single slider or can be in form of multiple sliders disposed in parallel grooves. The number is not restricted to two. Likewise, the axial length of the slider can be increased or reduced depending on the desired frictional co-efficient between the centraliser 10 and casing string C.

Typically, the rings 25, 26 are manufactured from a solid cylinder of PTFE by machining the outer diameter of the rings 25, 26 to the desired dimension in a lathe or mill, and then boring the inner diameter of the clamped cylinder. These steps can be reversed and the inner diameter can be bored before the outer diameter, although in that case, the inner diameter is typically supported before the milling step is performed on the outer diameter.

The preferred material for the friction reducing slider is PTFE, but other useful friction materials that can be used include typically one or more of polyetheretherketone, carbon reinforced polyetheretherketone, polyphthalamide, polyvinylindene fluoride, polyphenylylene sulphide, polyetherimide, polyethylene, polysulphone, polyethersulphone, polybutyleneterephthalate, polyetherketoneketone, polyamides, rubber and rubber compounds, phenolic resins or compounds, thermosetting plastics, thermoplastic elastomers, thermoplastic compounds or thermoplastic polyester resins.

A combination of these materials can also be used and fillers such as glass, silicone, disulphide, graphite, oil or wax are such combination can also be incorporated to the material of the slider.

The invention claimed is:

1. A centraliser having a body adapted to receive therewith in a length of tubing to be centralised, the body having a recess provided on an inner surface of the body, wherein the centraliser has a deformable friction-reducing slider disposed in the recess, wherein the slider has an inner diameter that is smaller than an inner diameter of the inner surface of the body, so that a portion of the friction reducing slider protrudes from the inner surface of the body, so as to bear against the tubing thereby spacing the inner surface of the body of the centraliser from the tubing to be centralised, and wherein the slider is in the form of an annular ring and has an outer diameter that is larger than an inner diameter of the recess so that the slider has to be deformed to be inserted into the recess and is held therein by radial compression of the outer diameter of the slider by the inner diameter of the recess.

2. A centraliser as claimed in claim 1, wherein the friction-reducing slider is formed separately from the body and subsequently attached thereto on the inner surface of the body so that it is adapted to bear between the outer surface of the tubing to be centralised and the inner surface of the centraliser.

3. A centraliser as claimed in claim 2, wherein the inner surface of the centraliser body has at least two recesses, and the body has at least two sliders disposed in respective recesses, and wherein said recesses are spaced apart on the inner surface of the centraliser body.

4. A centraliser as claimed in claim 3, wherein the spaced apart recesses are parallel to one another.

5. A centraliser as claimed in claim 1, wherein the body has a cylindrical bore with a central axis, and wherein the at least one recess extends radially at a right angle with respect to the axis.

6. A centraliser as claimed in claim 5, wherein the at least one recess has a rectangular cross section with radially extending side walls extending perpendicular to the axis.

7. A centraliser as claimed in claim 5, wherein the slider is in the form of an annular ring extending radially at a right angle with respect to the axis.

8. A centraliser as claimed in claim 1, wherein the centraliser is adapted to be used in a borebole, and wherein the centraliser has an outer surface and has blades on the outer surface adapted to bear against the inner surface of the borehole in which the centraliser is to be used, and wherein the body and the blades are formed by casting the centraliser as an unit.

9. A centraliser as claimed in claim 1, wherein the centraliser, is adapted to be used in a borebole, and wherein the centraliser has an outer surface and has blades on the outer surface, the blades being adapted to bear against the inner surface of the borehole in which the centraliser is to be used, and wherein the blades are formed separately and then subsequently attached to the centraliser body.

10. A centraliser as claimed in claim 1, wherein the friction-reducing slider is spaced from each end of the centraliser.

11. A centraliser as claimed in claim 1, wherein the friction-reducing slider is formed as a unitary band.

12. A centraliser as claimed in claim 1, wherein the slider is machined from a cylindrical bar of material.

13. A centraliser as claimed in claim 12, wherein the slider has an outer diameter and the outer diameter of the slider is machined on a lathe and the inner diameter is bored until the desired dimensions are obtained.

14. A centraliser as claimed in claim 1, wherein the slider comprises a low friction plastics material.

15. A centraliser as claimed in claim 14, wherein the low friction plastics material comprises at least one material selected from the group consisting of polytetrafluoroethylene (PTFE), polyetheretherketone, carbon reinforced polyetheretherketone, polyphthalamide, plyvinylindene fluoride, polyphenylylene sulphide, polyetherimide, polyethylene, polysulphone, polyethersulphone, polybutyleneterephthalate, polyetherketoneketone, polyam ides, rubber and rubber compounds, phenolic resins or compounds, thermosetting plastics, thermoplastic elastomers, thermoplastic compounds and thermoplastic polyester resins.

16. A centraliser as claimed in claim 14, wherein the slider includes a filler material selected from the group consisting of glass, silicone, disulphide, graphite, oil and wax.

17. A method of making a centraliser, the method comprising forming a body of the centraliser with a bore having an inner surface; forming a recess on the inner surface of the body of the centraliser; deforming a friction-reducing slider which has the form of an annular ring; and locating the slider in the recess of the body, the slider having an inner diameter that is smaller than an inner diameter of the inner surface of the body so that a portion of the friction reducing slider protrudes from the inner surface of the body for bearing against the tubing and thereby spacing the inner surface of the body of the centraliser from the tubing to be centralised, and having an outer diameter that is larger than an inner diameter of the recess so that the slider is held in the recess by radial compression of an outer diameter of the slider by an inner diameter of the recess.

18. A centraliser comprising:

a body provided with a cylindrical bore with a central axis, the bore being adapted to receive a length of tubing to be centralised within the bore:

a friction reducing slider;

the bore having an inner surface provided with an annular recess adapted to receive the friction-reducing slider therein, the annular recess being spaced from an end of the body of the centraliser, the annular recess being provided with first and second end walls extending radially with respect to the axis of the bore;

wherein the slider has an inner diameter and the centraliser body has an inner diameter and the inner diameter of the slider is smaller than the inner diameter of the centraliser body, so that a portion of the friction reducing slider protrudes from the inner surface of the centraliser, so as to bear against the tubular within the body, thereby spacing the inner surface of the body of the centraliser radially from the tubular to be centralised;

and wherein the slider and the recess each have an outer diameter that is larger than an inner diameter of the recess, whereby the slider is held in the recess by the radially extending side walls of the recess restraining axial movement of the slider along the body.

* * * * *